US007954731B2

(12) United States Patent
Antonucci et al.

(10) Patent No.: US 7,954,731 B2
(45) Date of Patent: Jun. 7, 2011

(54) LOW FLOW SPRINKLER

(75) Inventors: Thomas A. Antonucci, Azusa, CA (US); Brian W. Lees, Mountain View, CA (US); Valery A. Monge, Anaheim Hills, CA (US); Kelly F. Olischefski, Trabuco Canyon, CA (US); Michael F. Turk, Los Angeles, CA (US); Keith E. Turner, San Dimas, CA (US); Richard J. Russell, II, Tujunga, CA (US)

(73) Assignee: Rain Bird Corporation, Azusa, CA (US)

( * ) Notice: Subject to any disclaimer, the term of this patent is extended or adjusted under 35 U.S.C. 154(b) by 256 days.

(21) Appl. No.: 10/860,818

(22) Filed: Jun. 4, 2004

(65) Prior Publication Data

US 2004/0262426 A1 Dec. 30, 2004

Related U.S. Application Data

(60) Provisional application No. 60/555,941, filed on Mar. 23, 2004, provisional application No. 60/476,247, filed on Sep. 8, 2003, provisional application No. 60/476,114, filed on Jun. 4, 2003, provisional application No. 60/476,078, filed on Jun. 4, 2003, provisional application No. 60/476,067, filed on Jun. 4, 2003, provisional application No. 60/476,061, filed on Jun. 4, 2003.

(51) Int. Cl.
*B05B 3/14* (2006.01)

(52) U.S. Cl. ..... 239/230; 239/222.11; 239/222.17; 239/231; 239/255; 239/275; 239/288; 239/288.5

(58) Field of Classification Search ..... 239/222.11–222.19, 230–233, 239/DIG. 1, 390, 395, 200, 214.13, 225.1, 239/255, 273, 275, 288, 288.3, 288.5
See application file for complete search history.

(56) References Cited

U.S. PATENT DOCUMENTS 2,530,779 A * 11/1950 Owbridge ..... 239/231
(Continued)

OTHER PUBLICATIONS

European Search Report for European Patent Application No. 10151769.6, dated Apr. 19, 2010.

(Continued)

*Primary Examiner* — Jason J Boeckmann
(74) *Attorney, Agent, or Firm* — Fitch, Even, Tabin & Flannery

(57) ABSTRACT

A rotary impact sprinkler is disclosed having a nozzle connected to a housing and a discharge deflector member connected to a rotatable shaft assembly without a dynamic seal between the nozzle and the deflector. The sprinkler may be provided with different nozzles and discharge deflectors that are easily removed and replaced for providing desired water flow and discharge characteristics. The shaft assembly and housing may have contacting braking surfaces outside of the water flow. The braking surfaces may provide a frictional braking force dependent on both water flow rate and water flow pressure. The sprinkler has a rotatable impact assembly supported by the shaft assembly and including a deflection member for rotating the impact assembly relative to the shaft assembly. The shaft assembly may have a pin for supporting the impact assembly at a position above the deflection member. A lower portion of the shaft assembly may be positioned in a recess in the housing such that a surface on the shaft assembly contacts a surface in the recess, and a highly wear resistant material may be disposed on the surface of either the shaft assembly or the recess for providing improved wear characteristics. The deflection member of the impact assembly may have a channel that receives a portion of the water stream for rotating the impact assembly, and the channel may expel the water from the sprinkler. The discharge deflector may have a varying profile for discharging water at varying trajectories.

36 Claims, 10 Drawing Sheets

U.S. PATENT DOCUMENTS

| | | | | | |
|---|---|---|---|---|---|
| 3,009,651 | A | * | 11/1961 | Wolf | 239/222.13 |
| 3,022,012 | A | | 2/1962 | Sharp | |
| 3,408,009 | A | * | 10/1968 | Friedmann et al. | 239/230 |
| 4,182,494 | A | | 1/1980 | Wichman et al. | |
| 4,231,521 | A | | 11/1980 | Hermine | |
| 4,498,626 | A | | 2/1985 | Pitchford | |
| 4,566,632 | A | * | 1/1986 | Sesser | 239/230 |
| 4,625,915 | A | * | 12/1986 | Cockman | 239/390 |
| 4,660,766 | A | | 4/1987 | Nelson et al. | |
| 4,760,959 | A | | 8/1988 | Gorney | |
| 4,796,811 | A | | 1/1989 | Davisson | |
| 4,805,838 | A | * | 2/1989 | Greenberg | 239/222.17 |
| RE033,823 | E | | 2/1992 | Nelson et al. | |
| 5,098,020 | A | | 3/1992 | Cooper | |
| 5,476,223 | A | | 12/1995 | Drechsel | |
| 5,671,886 | A | * | 9/1997 | Sesser | 239/222.21 |
| 5,868,316 | A | * | 2/1999 | Scott | 239/73 |
| 5,971,297 | A | * | 10/1999 | Sesser | 239/222.21 |
| 5,992,760 | A | | 11/1999 | Kearby | |
| 6,095,432 | A | * | 8/2000 | Casagrande | 239/230 |
| 6,142,386 | A | * | 11/2000 | Spenser | 239/222.11 |
| 6,193,169 | B1 | | 2/2001 | Steinhilber et al. | |
| 6,260,770 | B1 | * | 7/2001 | Epstein et al. | 239/237 |

OTHER PUBLICATIONS

Examination Report for EP 05757250.5, issued on Oct. 7, 2010.

* cited by examiner

LOW FLOW SPRINKLER

CROSS-REFERENCE TO RELATED APPLICATIONS

This application claims benefit of U.S. Provisional Application No. 60/476,078, filed Jun. 4, 2003, entitled "Impact Sprinkler with Improved Drive Bearing Configuration," claims benefit of U.S. Provisional Application No. 60/476,061, filed Jun. 4, 2003, entitled "Impact Sprinkler Without a Dynamic Seal," claims benefit of U.S. Provisional Application No. 60/476,067, filed Jun. 4, 2003, entitled "Ceramic Bearing Material in Rotary Impact Sprinkler," claims benefit of U.S. Provisional Application No. 60/476,114, filed Jun. 4, 2003, entitled "Flow Dependent Brake in an Impact Sprinkler," claims benefit of U.S. Provisional Application No. 60/476,247, filed Sep. 8, 2003, entitled "Deflector Impact Sprinkler," claims benefit of U.S. Provisional Application No. 60/555,941, filed Mar. 23, 2004, entitled "Water Disrupting Features Attached to Moving Impact Mechanism," and is related to U.S. Design patent application No. 29/206,857 filed Jun. 4, 2004, and issued as U.S. Pat. No. D516,699, entitled "Sprinkler." All of the foregoing applications are incorporated herein by reference as if set forth in their entirety herein.

FIELD OF THE INVENTION

The invention relates to a rotary impact sprinkler and, in particular, to a rotary impact sprinkler with improved dwell time, improved braking, improved friction characteristics, improved spray characteristics, and improved protection from interference from the environment.

BACKGROUND OF THE INVENTION

Impact sprinklers have been used since the 1930's for distributing water, for instance, in agricultural irrigation. A typical impact sprinkler utilizes a discharge member or deflector directing water into a spoon connected to an impact arm. The impact arm is connected to a torsion spring biasing the spoon towards the water stream such that the spring absorbs a portion of the kinetic energy and momentum of a portion of the water stream as the water strikes the spoon. The water strikes the spoon for a period of time while also causing the spoon to be moved away from the water stream by rotating around a generally vertical axis. In doing so, the shape of the spring is changed from its natural position, thereby storing potential energy and providing a return bias force.

The momentum of the moving spoon causes the spoon and impact arm to move completely away from the water stream, at which time the water is free to expel unimpeded. However, in the absence of water contacting the spoon, the stored energy of the spring is expelled by directing the spoon back toward the water stream. The amount of time during which the spoon is not being contacted by the water stream is known as the dwell time.

As the spoon and impact arm return, the spoon once again passes through the water stream. Because the impact arm and the structure to which it is connected have mass and, therefore, inertia, the return of the impact arm strikes the structure to which the deflector is connected. This striking causes the discharge member and its associated structure to rotate a short distance around the generally vertical axis in the direction of the return of the impact arm. However, the water stream once again strikes the spoon such that the spoon and impact arm are moved out of the stream and against the bias of the spring, and the process is repeated.

During the dwell time, the water stream is free to expel unimpeded. However, in such a state, the water stream takes a short time period to build up maximum throw distance. That is, the presence of the spoon in the stream causes a shortening of the distance to which the water stream may expel. When the spoon is moved out of the water stream, there is a time period required for the water to reach the distance which can be achieved with continued absence of interference. Though this time period is relatively short, it is common for the spoon to return to an interference position before the water stream is able to achieve a maximum distance. This reduces the coverage area of the sprinkler and concentrates the water in a smaller area.

The coverage area of the sprinkler is also influenced by the discharge member, such as a nozzle discharge. Typically, the nozzle discharge expels the water at a fixed trajectory angle. In the absence of the spoon and once the water stream reaches its maximum distance very little water will be spread at shorter distances. In such a system, it is only by virtue of errant spray and the spoon interfering with and slowing down the water stream that water is deposited short of the maximum distance. The ability to change water trajectory is afforded by changing out the entire sprinkler for another sprinkler with a different nozzle discharge trajectory.

The energy directing the spoon out of the water stream, or drive energy, is stored in the torsion spring. However, friction between moving parts wastes a portion of the drive energy. It is common for the impact arm and its structure to be supported by a lower thrust bearing member or surface that contacts a sprinkler body or the rotating shaft and nozzle portion. This friction reduces the efficiency in transferring energy from the kinetic energy of the water stream to potential energy in the torsion spring.

To maximize dwell time, the impact arm should pass as far out of the water stream as possible. To achieve this, the impact arm is given a high mass while the torsion spring is given a low spring constant, and the spring is then referred to as a light spring.

One way of increasing dwell time would be to remove the lower thrust bearing. In the absence of the lower thrust bearing surface, the impact arm and its structure must be supported, most commonly by hanging the structure from its torsion spring. However, the torsion spring in such a system requires a sufficient size to support the mass of the impact arm and its structure. This sacrifices the amount that the spring is able to deform due to the deflection before all the energy is converted to potential energy. Accordingly, the impact arm ceases moving away from the water stream and begins to return towards the water stream. Consequently, dwell time is reduced as the impact arm returns quickly, and the overall impact frequency is high. Therefore, the water stream is not able to achieve the maximum distance.

Another shortcoming encountered with impact sprinklers is the variation in performance of the sprinkler under varying water pressures. More specifically, a sprinkler has a range of pressure under which quality performance is achieved. Outside of that range, the sprinkler suffers from poor performance, such as by rotating erratically or spinning rapidly out of control.

Water pressure can be affected by a number of factors, such as the source pressure, the pressure created by the water through the nozzle, and the shape of the discharge member. In order to avoid the sprinkler rotating erratically or spinning rapidly out of control and to optimize the performance characteristics of the sprinkler, the rotation time should be relatively constant or within a narrow range under different water flow and pressure characteristics.

One approach to control the rotation time of the sprinkler under varying water pressure utilizes a water-pressure actuated braking mechanism. Generally, this braking is done by using a stack of washers and a compression spring located against the previously mentioned lower thrust bearing member or surface. The washers are located in the water stream and below the point at which water enters the sprinkler. More specifically, the term sprinkler refers generally to the sprinkler head that includes threads on its lower end for securing to a stem or pipe that delivers water from the water source. The rotating portion of the impact sprinkler includes the nozzle entry, which is in turn located adjacent the washers. The washers are located within or below the threads of the sprinkler and the water pressure forces the washers against the sprinkler nozzle to form a dynamic seal with the moving nozzle.

In this type of braking system, braking force increases with increased water pressures. In addition, as the braking force increases, so does the drive energy. That is, the energy stored by the torsion spring for returning the impact arm returns. Though the impact frequency does not significantly increase, the angular distance traveled by the rotating part of the sprinkler including the nozzle discharge for each impact increases such that the time for a single rotation to be completed by the sprinkler, known as the rotation time, decreases. As the rotation time decreases, the distance achieved by the water stream decreases, and the water stream begins to tail. Because of these, the range of operating pressures that provide quality performance narrows.

The described braking system utilizing washers and a dynamic seal only recognizes pressure and not flow rate. This is because the washer stack is positioned in the flow of water from the stem, prior to the water passing through the nozzle, an arrangement typically necessitated by using the nozzle and water discharge as a single component which must be permitted to rotate with the rotation of the direction of the water stream. However, when nozzles or nozzle discharges with different flow rates are used, the pressure may vary differently, or not at all. Accordingly, this braking system cannot control the rotation time under different flow rates, which results in a varied rotation time. The varied rotation time limits a sprinkler to provide optimal performance only over a smaller or narrower range of water flow specification.

An important characteristic of the systems as described is the use of bearings and braking surfaces that rely on friction. As is known, friction has a cumulative negative effect on the life and performance of a sprinkler. It is also known that water commonly used in agricultural settings contains debris including, for instance, sand, rocks, dirt, and volcanic particles. In the described thrust bearing and washer brake configurations, this debris can become lodged between the surfaces and accelerate the wear on the moving parts. Furthermore, grit can enter the dynamic seal formed by the washers and bind the mechanism.

Despite the large-scale applications for which impact sprinklers are used, these systems still utilize relatively fragile components susceptible to damage and external interference. For instance, it is known that weeds or proximally growing verdure and brush can grow into the sprinkler mechanism, thereby clogging the mechanism and preventing its proper operation. In addition, it is known that accidental external striking of the sprinklers, such as by dropping a sprinkler, can occur and cause damage.

Accordingly, there is a need for improved rotary impact sprinklers.

DESCRIPTION OF THE PREFERRED EMBODIMENT(S)

Figure 1:
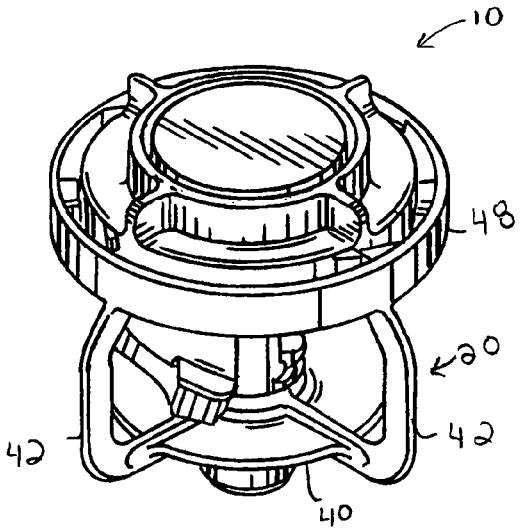
FIG. 1 is a perspective view of a sprinkler head including features of the present invention.

Referring initially to FIGS. 1-5, a sprinkler head 10 is depicted embodying features of the present invention. The sprinkler head 10 is utilized with a stem (not shown) as part of an irrigation system that may incorporate a plurality of sprinkler heads 10 and a system of piping delivering water from a water source to the sprinkler heads 10 to distribute water therefrom. The stem is generally a cylindrical pipe end that includes internal threads with which threads 12 of the sprinkler head 10 are mated. The threads 12 of the sprinkler head 10 are externally located on a generally hollow sprinkler mount section 14 which has a generally frusto-conical outer cross-section.

The sprinkler head 10 includes a base or housing 20, a discharge member in the form of a first deflector 22, a nozzle 24, a bearing 26, and a sprinkler or discharge assembly 28. The nozzle 24 may be secured manually or otherwise to the housing 20, as will be described below. The deflector 22 and bearing 26 may be secured to the sprinkler assembly 28 similarly, and the combination may then be secured to the housing 20, each of which will also be described below.

The housing 20 is preferably made of a resiliently deformable thermoplastic material. The lowest portion of the housing 20 includes the mount section 14 for securing to the stem, as described. The housing includes protecting structure for the sprinkler head 10. Extending radially from a top portion of the mount section 14 is a disc-shaped plate 40. When weeds or other plants grow upwardly from below the sprinkler head 10, the plate 40 serves to prevent the plants from growing into the sprinkler head 10, thereby reducing the possibility that such plants may become entangled in and prevent operation of the sprinkler head 10.

The housing 20 may further include other protecting structure such as a plurality of radially extending and spaced ribs 42. Each rib 42 preferably includes a radial portion 44 initially extending along the plane of the plate 40, though also extending above and below the plate 40. In this portion 44, the ribs provide additional structural integrity to the plate 40 and to the sprinkler head 10 in general. The ribs 42 further extend beyond the plate 40 and include a section 46 generally extending upward and joining with a sprinkler assembly mounting ring 48. The section 46 also prevents plants from growing into or moving into contact with the sprinkler assembly 28, as well as provides impact resistance to absorb accidental striking of the sprinkler head 10 while reducing likelihood that any impact should damage the operation of the sprinkler head 10. The housing 20 is depicted with four such ribs, though the number may be varied, as well as the size and shape of each. Preferably, the ribs 42 are relatively thin such that water being radially discharged by the sprinkler head 10 is minimally impeded or obstructed.

Figure 2:
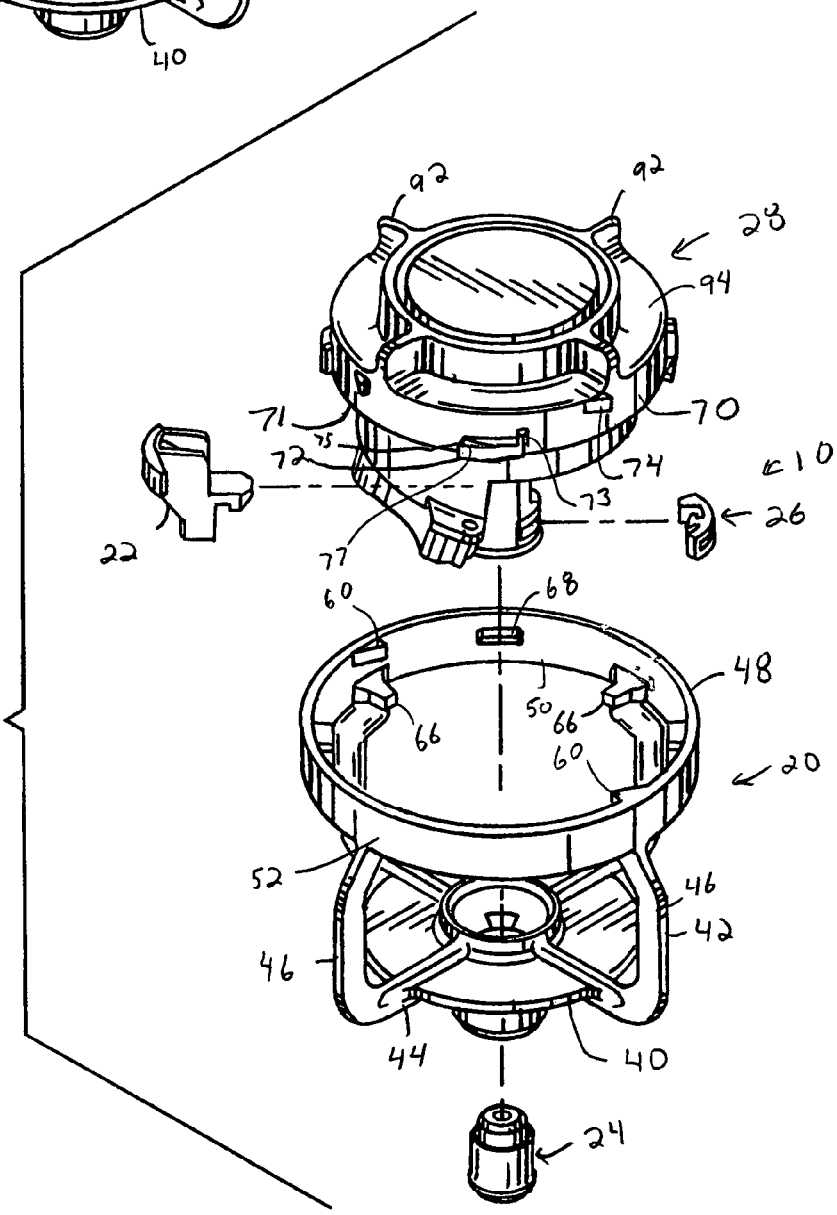
FIG. 2 is a partially exploded view of the sprinkler head of FIG. 1 depicting a housing, a nozzle, a deflector, a bearing, and a sprinkler assembly.
Figure 3:
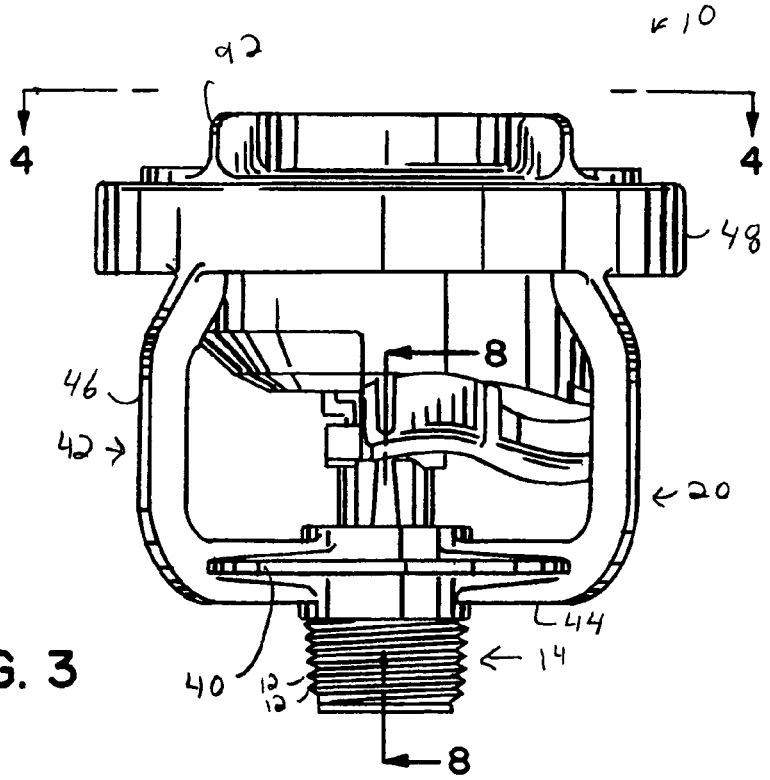
FIG. 3 is a side elevation view of the sprinkler head of FIG. 1.
Figure 4:
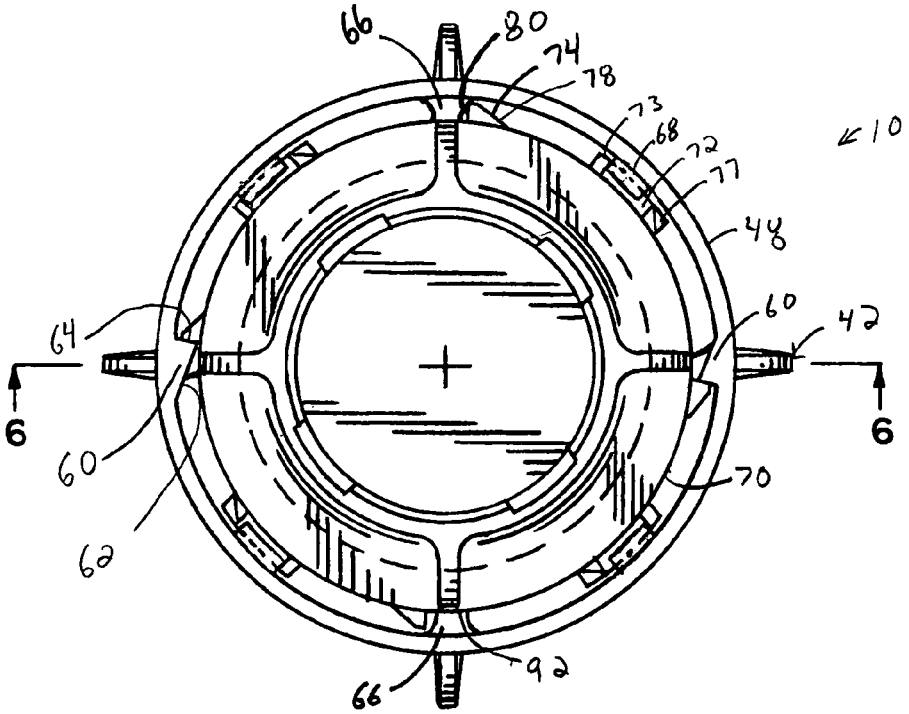
FIG. 4 is a first top plan view of the sprinkler head of FIG. 3 depicting the housing in a first, uncompressed position and depicting the sprinkler assembly in locked and installed position.
Figure 5:
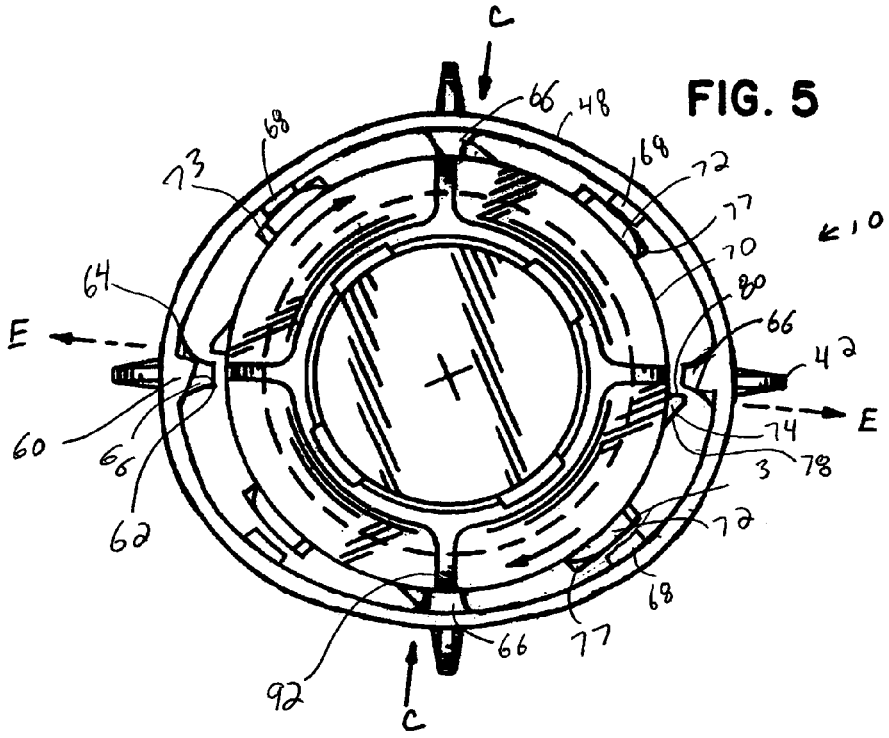
FIG. 5 is a second top plan of the sprinkler head of FIG. 3 depicting the housing in a second, compressed position and depicting the sprinkler assembly rotated to an unlocked and un-installed position.

Referring more specifically to FIGS. 2, 4, and 5, the sprinkler assembly mounting ring 48 can be viewed securing the sprinkler assembly 28 to the housing 20. The mounting ring 48 is generally annular with an inner surface 50 and an outer surface 52. Located on the inner surface 52 is a plurality of inwardly extending stops 60. Each stop 60 has a ramped surface 62 and a stop surface 64. The inner surface 52 also includes a plurality of inwardly extending support flats 66 and stop tabs 68.

The sprinkler assembly 28 includes an outer radial mount surface 70 on a body assembly 100 having a bottom edge 71 (see FIG. 2). The bottom edge 71 rests on the support flats 66 of the mounting ring 48 to support the sprinkler assembly 28. The mount surface 70 further includes radially extending stop flats 72. Each stop flat 72 is a generally flat, horizontal portion with a vertically rising stop 73 at one end of the flat 72. When the sprinkler assembly 28 is secured within the mounting ring 48, the stop flats 72 are positioned below and abutting with the stop tabs 68 of the mounting ring 48. In such secured position, the sprinkler assembly 28 is rotated until the stop tabs 68 abut the vertical stop 73 of the stop flat 72. A leading portion 75 of the stop flats 72 may have a slight cam or chamfer 77 for directing the stop flat 72 below the stop tabs 68. Furthermore, the mount surface 70 includes a plurality of outwardly extending mount stops 74 similar to the stops 60 of the mounting ring 48 and having a ramped surface 78 and a stop surface 80.

In FIG. 4, the sprinkler assembly 28 is secured to the housing 20. More specifically, stop surfaces 64 of the mounting ring 48 abut the stop surfaces 80 of the mount surface 70, thereby preventing rotation of the sprinkler assembly 28 relative to the mounting ring 48. The stop flats 72 of the sprinkler assembly 28 are abutting and are below the stop tabs 68 of the mounting ring 48. The bottom edge 71 of the body assembly 100 rests on the support tabs 66. In this manner, the sprinkler assembly 28 is prevented from being extracted from the mounting ring 48 without being rotated relative thereto.

In order to rotate the sprinkler assembly 28 relative to the mounting ring 48 to permit the sprinkler assembly 28 from being removed, the abutting relationship between the corresponding stops 60 and 74 may be removed. To effect this, the mounting ring 48 may be compressed, as can be seen in FIG. 5, by directing force in the direction of arrows C such that a portion of the mounting ring 48 deforms outward in the direction of arrows E. This compressing of the mounting ring 48 deforms the shape of the mounting ring 48 so that the sprinkler assembly 28 may be moved within the mounting ring 48.

When the mounting ring 48 is compressed, the stops 60 of the mounting ring 48 are displaced away from the stops 74 of the sprinkler assembly 28 such that the stop surfaces 64, 80 are no longer in contact. In this position, the sprinkler assembly 28 may be rotated relative to the mounting ring 48 such that the stop flats 72 of the sprinkler assembly 28 are freed from the stop tabs 68 of the mounting ring 48. The sprinkler assembly 28 may then be removed from the housing 20, and may be done so manually. The sprinkler assembly 28 is provided with upstanding walls 92 from a top surface 94 with which the sprinkler assembly 28 may be gripped to effect turning.

Figure 6:
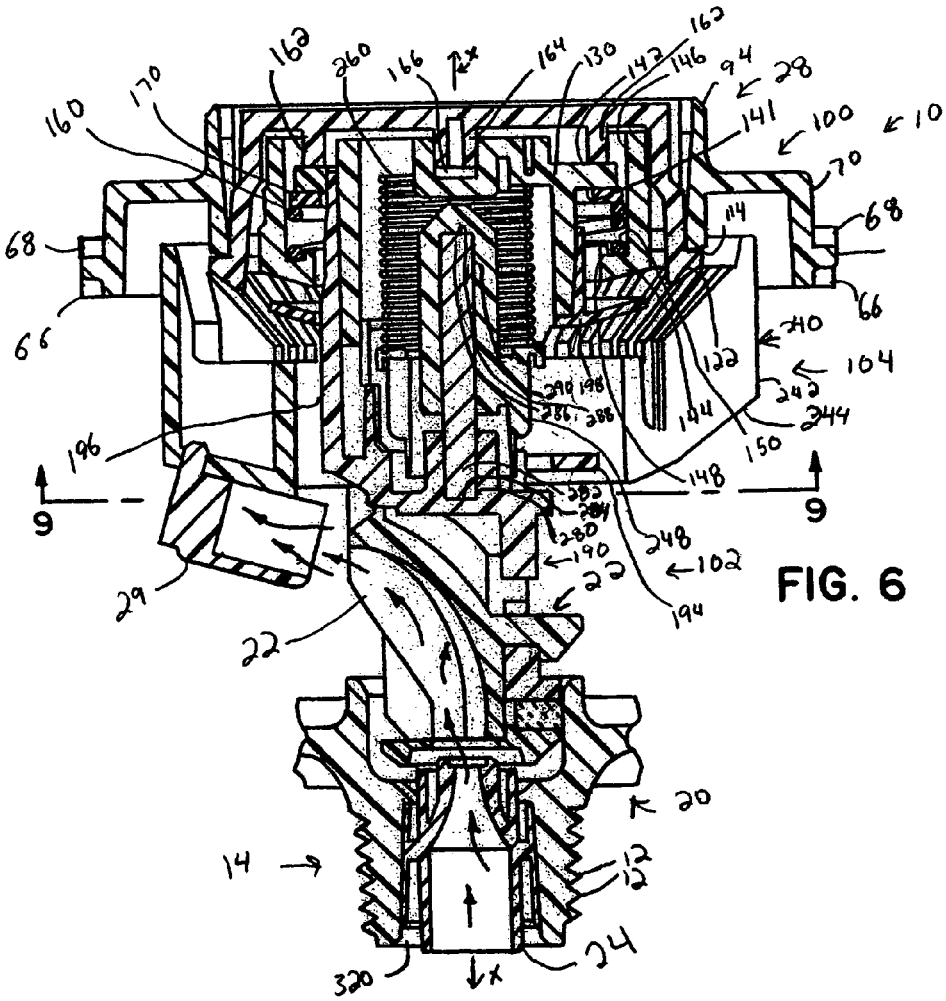
FIG. 6 is a partial cross-sectional view of the sprinkler head of FIG. 1 taken along the line 6-6 of FIG. 4.
Figure 7:
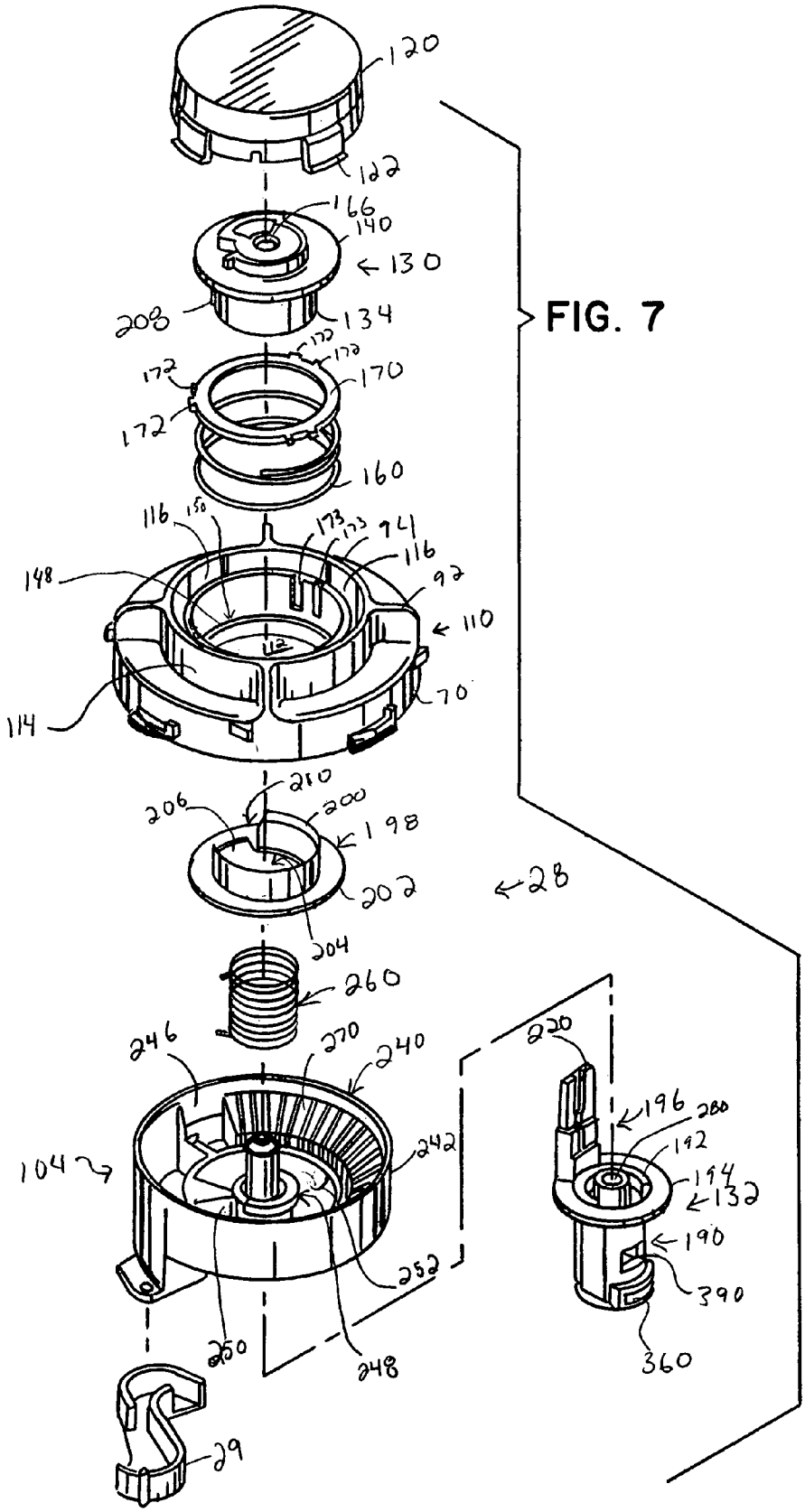
FIG. 7 is an exploded view of the sprinkler assembly of FIG. 2.

Referring now to FIGS. 6 and 7, the sprinkler assembly 28 includes the body assembly 100, a shaft assembly 102, and an impact assembly such as disk assembly 104, each of which may to move relative to each for operation of the rotary impact sprinkler. More specifically, the body assembly 100 includes a mount cap 110 including the mount surface 70 for securing to the mounting ring 48, as described, and generally remains stationary during operation. The mount cap 110 includes a central passage 112 in its top surface 94 defined by an inner annular wall 114 that joins with each of the upstanding walls 92. A brake cap 120 whose operation will be described in further detail below is inserted into the central passage 112 and includes a number of resilient pronged tabs 122 which are received in openings 116 in the top surface 94 of the mount cap 110 within the area defined by the annular wall 114. The pronged tabs 122 may deform inwardly during insertion into the openings 116 and then flex back to a natural position in order to be in an interference position with a bottom edge 114 of the annular wall 94, as shown in FIG. 6.

The shaft assembly 102 (see FIG. 6) principally includes an upper shaft section 130 and a lower shaft section 132 which are joined through the disk assembly 104, as will be described in further detail below. The upper shaft section 130 includes a cylindrical body 134 and an annular flange 140 extending radially from the upper shaft section 130 and having a bottom surface 141 and a top surface 142. The central passage 112 of the mount cap 110 includes an annular flange 144 extending inwardly from the inner surface 146 of the central passage 112. An annular wall 148 extends upward from the innermost edge of the annular flange 144, thereby defining an annular channel 150 located proximate to the inner surface 146.

During assembly, a compression spring 160 is placed in the central passage 112 and its bottom rests in the channel 150, and a spring washer 170 is placed on the top of the spring 160. The spring washer 170 includes short tabs 172 projecting radially and which are received by small recesses 173 defined by the inner surface 146 so that the spring washer 170 is generally prevented from rotating relative to the mount cap 110. The upper shaft section 130 is inserted into the central passage 112 so that the cylindrical body 134 of the upper shaft section 130 is received inside the annular flange 144 and the annular wall 114. Furthermore, the bottom surface 141 of the annular flange 140 contacts the spring washer 170 to compress the compression spring 160 between the spring washer 170 and the annular flange 144. The brake cap 120 has an annular wall 162 extending downward and having pressure contact with the top surface 142 of the annular flange 140 of the upper shaft section 130 due to the force of the spring 160, as will be described below in further detail.

The brake cap 120 further includes a generally round post 164 generally co-axial with an axis of rotation X. The top surface 142 of the upper shaft section 130 further defines a cylindrical recess 166 generally co-axial with axis X and shaped complementary to receive a portion of the post 164. Together, the post 164 and recess 166 form a bearing point for keeping the shaft assembly 102 and disk assembly 104 in proper alignment with the body 100 and the sprinkler head 10 in general.

The lower shaft section 132 connects with the upper shaft section 132 such that the two are generally secured and stationary relative to each other. The lower shaft section 130 has a central body 190 with an upper inner surface 192, an annular flange 194 extending radially from generally the surface 192, and a stepped extension 196 extending upward from the flange 194.

During assembly, the stepped extension 196 passes through the disk assembly 104 and secures with the upper shaft section 130. More specifically, the shaft assembly 102 includes a brace 198 intermediate with the upper and lower shaft sections 130, 132. The brace 198 has a partial annular, cylindrical wall 200 and an axially extending annular flange 202 forming a generally circular opening 204. In addition, the annular flange 202 defines a partially annular recess 206 which opens into the opening 204. The outer surface of the cylindrical body 134 of the upper shaft section 130 includes an outwardly stepped, partially annular, elongated section 208. When the brace 198 and upper shaft section 130 are joined, the stepped section 208 extends into the recess 206.

When the upper shaft section 130 and the lower shaft section 132 are joined, the stepped extension 196 also extends through the recess 206 of the brace 198 and mates with the stepped section 208 of the upper shaft section 130 in a dovetail arrangement. More specifically, the recess 206 defines an elongated channel 220 having a shape that complements that of the stepped, elongated section 208 and the upper shaft section 130. The stepped section 208 is slidably received in the elongated channel 220. As a result, the upper shaft section 130 and lower shaft section 132 are interconnected with another.

As mentioned, the stepped extension 196 of the lower shaft section 132 is inserted through the disk assembly 104. The disk assembly 104 includes a shell 240 with an upper, generally cylindrical outer surface 242, a lower, generally frustoconical outer surface 244, an interior generally cylindrical surface 246, a central collar 248, a bridge or impact member 250 connecting the central collar 248 to the interior surface 246, and a partially annular opening 252 defining a travel path for the stepped extension 196 to move relative to the disk assembly 104. More specifically, the central support 248 is located at the center of the opening 252 and coaxial with the axis X. The central collar 248 is generally surrounded by the opening 252, other than the bridge 250 which connects the rest of the disk assembly 104 with the central support 248.

As stated, the stepped extension 196 extends through the opening 252 of the disk assembly 104. By minimizing the size of the bridge 250, the disk assembly 104 and stepped extension 196 are provided the greatest rotational sweep relative to each other before the stepped extension 196 contacts the bridge 250.

The shaft assembly 102 and disk assembly 104 are provided with a torsion spring 260 biasing the assemblies 102, 104 to a position where a water stream exiting the deflector 22 connected to the shaft assembly 102 may contact a second deflector or spoon 29 also connected to the disk assembly 104. The torsion spring 260 may be secured at one end to the upper shaft section 130 of the shaft assembly 102 and at the other end to the bridge 250 of the disk assembly 104, though it should be noted that the spring 260 may connect to these assemblies in a variety of positions.

The force of the water stream will cause the spoon 29 to rotate out of the water stream, causing the disk assembly 104 to rotate relative to the shaft assembly 102. This movement causes the torsion spring 260 to store energy. Once the spoon 29 exits the water stream, the stored energy of the torsion spring 260 forces the disk assembly 104 to return to the position where the water stream again may contact the spoon 29. When the disk assembly 104 returns, the bridge 250 contacts the stepped extension 196 with an impact, causing the shaft assembly 102 to rotate a short distance around the axis X relative to the mount cap 110 and housing 20. The disk assembly 104 is provided with mass structure 270 to increase the impact force when the disk assembly 104 strikes the stepped extension 196. The torsion spring 260 preferably has a low spring constant so that the amount of rotation of the disk assembly 104 due to the water stream is maximized, thereby increasing the amount of time the water is free to expel unimpeded, as discussed above.

In order to utilize a torsion spring 260 with a low spring constant, the disk assembly 104 must be supported by other structure. The body 190 of the lower shaft section 132 includes a blind pilot 280 generally co-axial with the axis X. The pilot 280 receives a lower end 284 of a pin 282, while an upper end 286 of the pin 282 is received in a blind hole 290 in the central support 248 of the disk assembly 104, as can best be seen in FIG. 6. The depth of the blind hole 290 of the disk assembly 104 helps retard deviation of the disk assembly 104 when a water stream contacts the deflector 22. The force of the water on the spoon 29 causes an upward lift to the disk assembly 104 such that contact between a top surface 288 of the pin 282 and the blind hole 290 is sporadic and more predominant as the shaft assembly 102 rotates back toward the water stream, and the friction is reduced between side surfaces of the pin 282 and the blind hole 290 due to rotation.

By minimizing the contact area between the top surface 288 of the pin 282 and the blind hole 290, the torque due to friction during rotation is reduced. In this manner, the mass of the disk assembly 104 can be increased and a light spring may be used as described, thereby producing a greater dwell time.

The combination of these features provides a superior impact sprinkler. By way of example, the disk assembly may 104 have a mass of 28.5 grams, or 0.063 pounds, and the frictional torque at the contact area between the top surface 299 of the pin 282, having a diameter of 0.105 inches, and the blind hole 290 is $2.6\times10^{-4}$ pound-inches. Utilizing a torsion spring 260 with a spring constant of 0.0019 inch-ounces/degree of rotation, the dwell time is on the order of 0.3 seconds. In comparison, a dwell time in the order of 0.1 seconds is most common. Combined with the deflector 22, the sprinkler 10 provides superior water distribution.

As has been mentioned, the deflector 22 for dispersing and expelling the water stream is connected to the lower shaft assembly 132. The deflector 22 is generally in communication with the nozzle 24, which is secured in the housing 20. Water enters the sprinkler head 10 at the mount section 14 and, then, passes through the nozzle 24. The water is directed upwardly in a stream against the deflector 22, and the deflector 22 re-directs the water outwardly from the sprinkler head 10. After exiting the deflector 22, the water stream may contact the spoon 29 to cause rotation of the disk assembly 104 relative to the water stream to a point where the stream is then free to expel unimpeded.

It should be noted that the nozzle 24 and deflector 22 are separate items. The nozzle 24 forms a seal with the housing 20, concentrates the water flow to the desired pressure and flow rate, and discharges the water against the deflector in a stream. Accordingly, no dynamic seal is necessary between the deflector 22 and the housing 20 or stem. In this manner, the likelihood of grit or particulate matter in the water stream becoming entrapped between moving parts is reduced and in some cases eliminated, thereby providing a longer life to the sprinkler head 10 and avoiding problems associated with stuck or damaged sprinkler heads 10.

Figure 22:
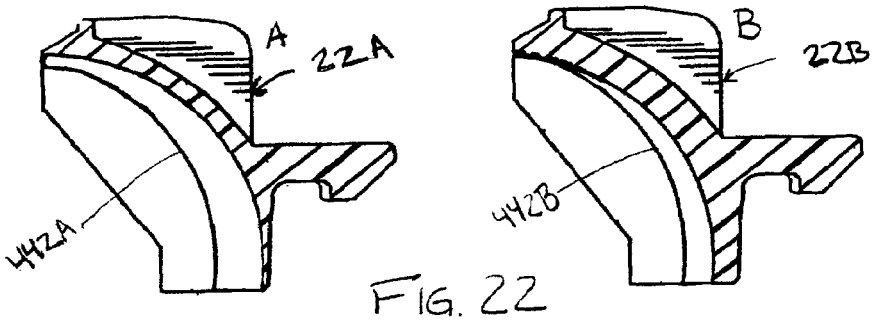
FIG. 22 is a cross-sectional view of a plurality of deflectors.
Figure 23:
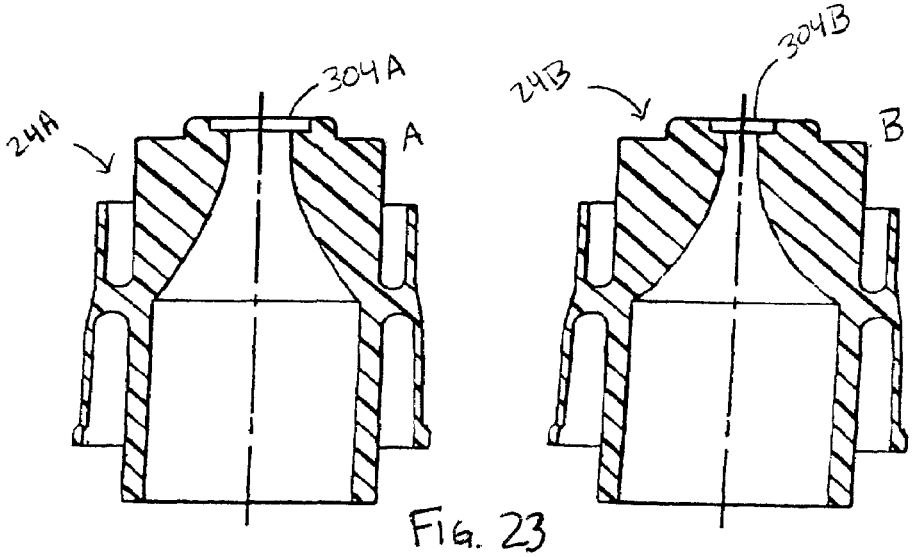
FIG. 23 is a cross-sectional view of a plurality of nozzles.

The throw distance, throw pattern, and flow rate are controlled by the nozzle 24 and deflector 22. The sprinkler head 10 may be provided with a number of different nozzles 24 and deflectors 22 depending on the desired performance characteristics. In the preferred embodiments, a number of different deflectors 22 and nozzles 24 are interchangeable, i.e., they are easily installed and removed. Referring to FIG. 22, two deflectors 22A and 22B are shown, wherein the deflector surface 442A of deflector 22A is larger than the deflector surface 442B of deflector 22B. Thus, deflector 22A will produce a different flow characteristic than deflector 22B. The deflectors are interchangeable within the system to change the flow characteristic of the water stream discharging from the sprinkler. Similarly, and as shown in FIG. 23, two nozzles 24A and 24B may be provided with nozzle 24A having a larger exit diameter 304A than the exit diameter 304B of nozzle 24B. Thus, nozzle 24A will produce a different flow characteristic than deflector 24B and the nozzles are interchangeable within the system to provide a different flow rate for the water stream being received by the deflector. The preferred deflectors and nozzles are color-coded to coordinate with the performance characteristics they provide for easy identification.

Figure 8:
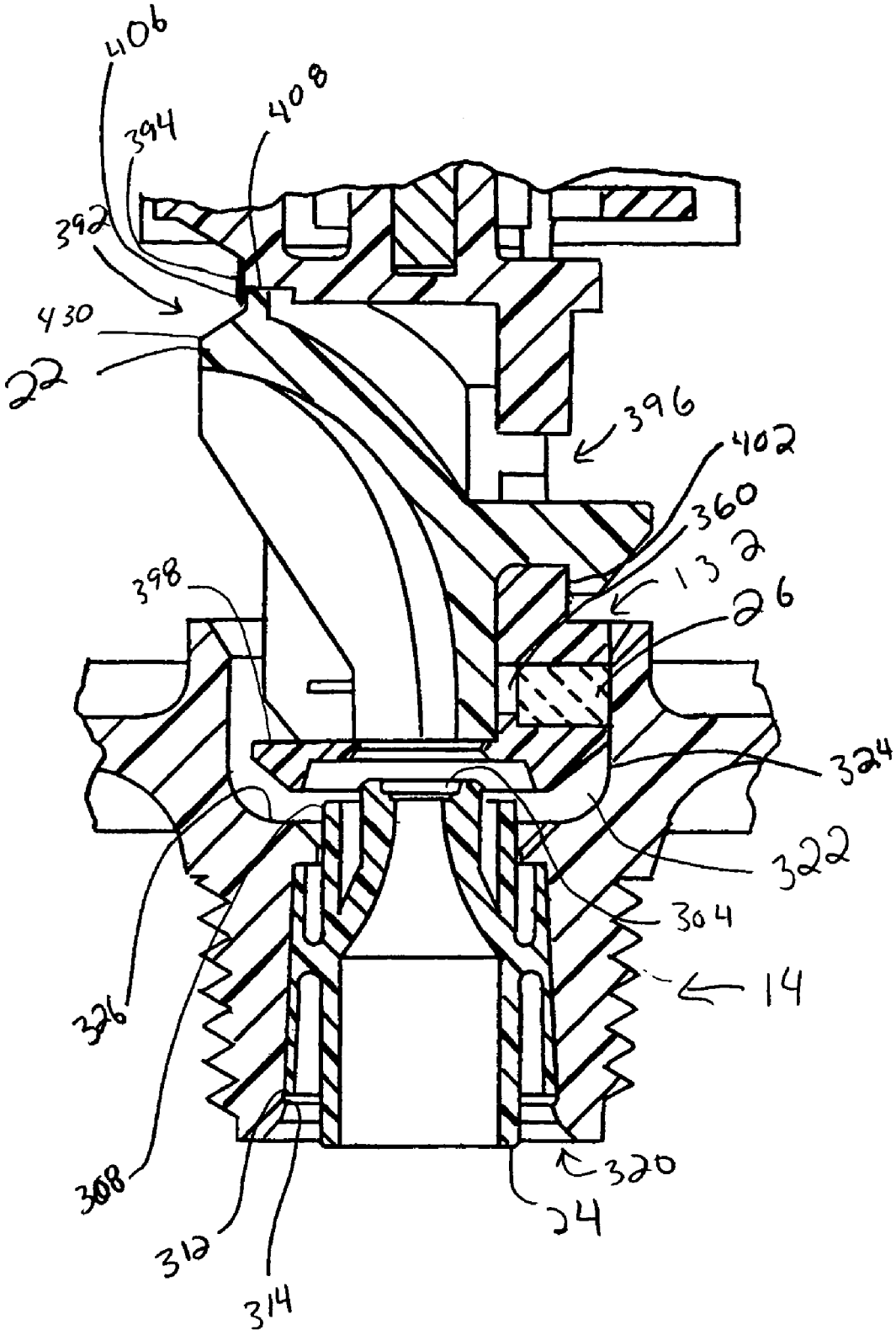
FIG. 8 is a partial enlarged view of the sprinkler head of FIG. 6.
Figure 10:
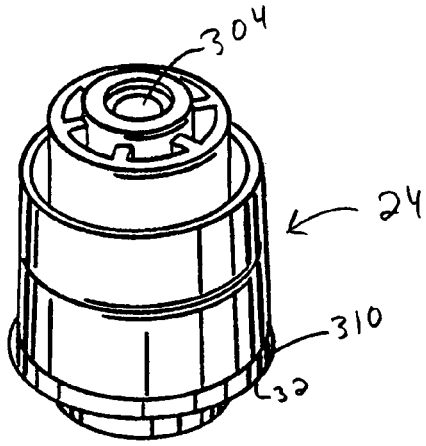
FIG. 10 is a perspective view of an embodiment of the nozzle of FIG. 2.
Figure 11:
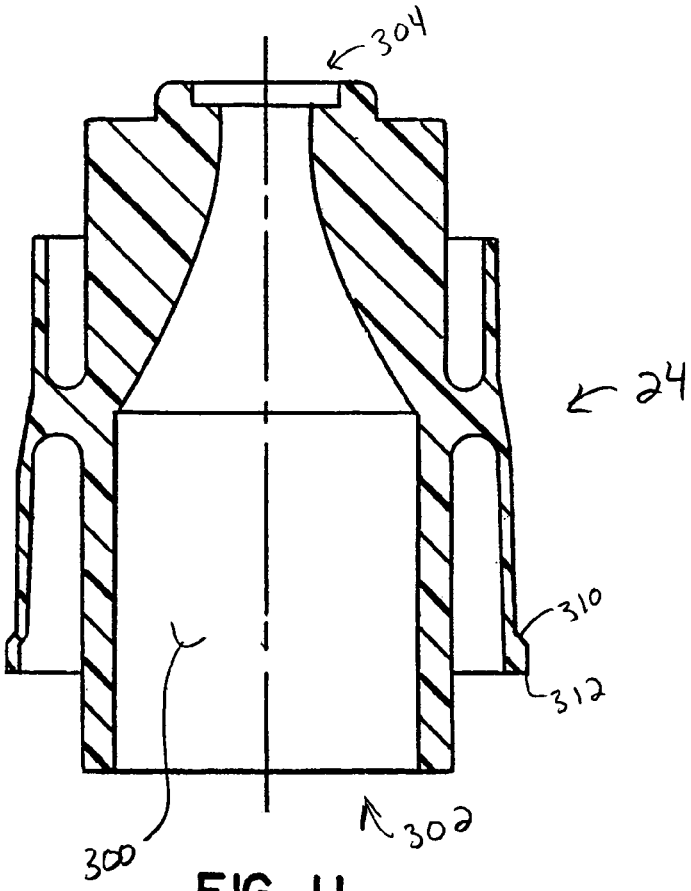
FIG. 11 is a cross-sectional view of the nozzle of FIG. 10.
Figure 12:
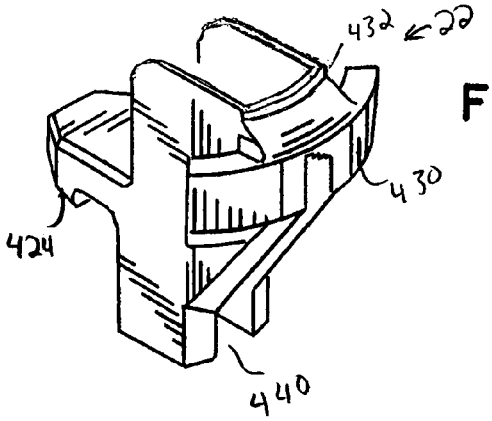
FIG. 12 is a first perspective view of an embodiment of the deflector of FIG. 2.
Figure 13:
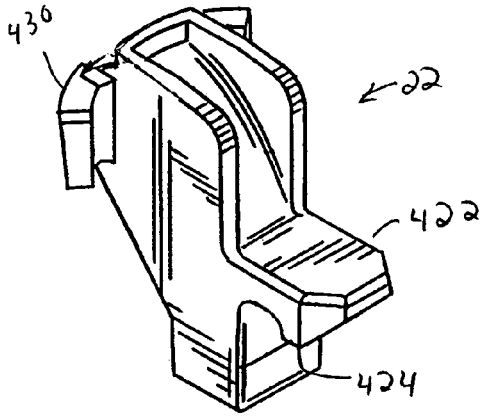
FIG. 13 is a second perspective view of the deflector of FIG. 12.
Figure 14:
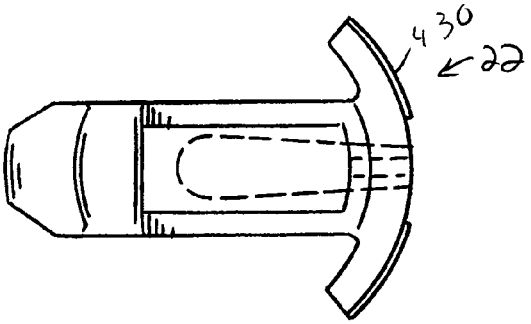
FIG. 14 is a top plan view of the deflector of FIG. 12.
Figure 15:
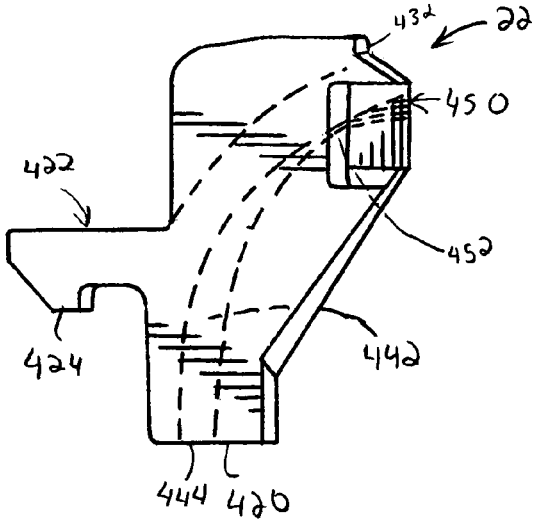
FIG. 15 is a side elevation view of the deflector of FIG. 12.
Figure 16:
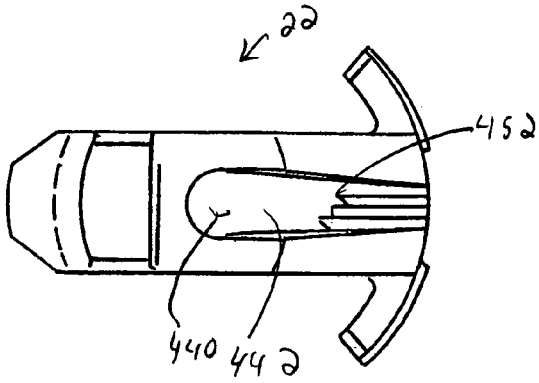
FIG. 16 is a bottom plan view of the deflector of FIG. 12.
Figure 17:
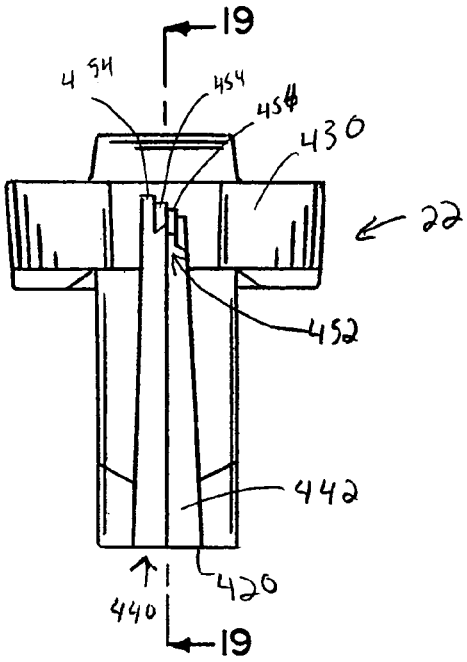
FIG. 17 is a front elevation view of the deflector of FIG. 12.
Figure 18:
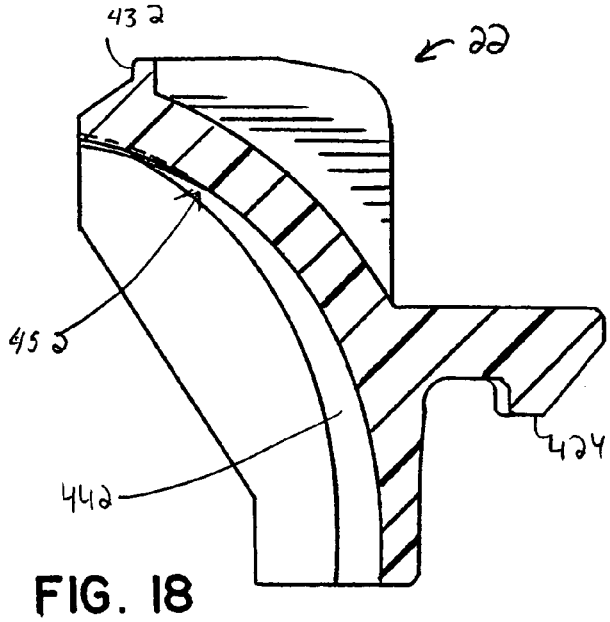
FIG. 18 is a cross-sectional view of the deflector of FIG. 12.

As can be seen in FIGS. 8, 10, and 11, the nozzle 24 has a central flow path directing chamber 300 with an entry 302 for receiving water from the water source into the sprinkler head 10, and an exit or discharge 304 for directing the water against the deflector 22. Between the entry 302 and exit 304, the flow path 300 is contoured to curve inward at a predetermined rate in the direction of water flow for forming the desired water stream and flow rate. Various nozzles 24 may be provided with an entry 302 diameter of 0.318 inches and with an exit 304 diameter of 0.0781, 0.0859, 0.0938, or 0.1016 inches.

The nozzle 24 seats into the bottom of housing 20, and more particularly into the mount section 14. In this manner, the force of the water will not dislodge the nozzle 24 from its a seated position longitudinally within the mount section 14. The housing 20 includes a nozzle mount 320 comprising a stepped interior cavity with a plurality of generally cylindrical or conical sections to match generally the exterior of the nozzle 24, the geometry of which could be altered without any difference in the performance.

The housing 20 further includes a shaft assembly bearing recess 322 with a generally cylindrical wall 324 and a generally flat bottom 326. As can be seen in FIG. 8, the lowermost portion of the lower shaft section 132 is located within the shaft assembly bearing recess 322, and an upper portion 308 of the nozzle 24 extends above the bottom 326 of the shaft assembly bearing recess 322.

The nozzle 24 is snap-fit, preferably manually, into the housing, though other means may be used. The exterior of the nozzle 24 includes an annular ramp 310 leading to an annular shoulder 312, and the housing 20 includes an annular ridge 314 against which the ramp 310 may be pressed during insertion. Once the ramp 310 passes by the ridge 314 during insertion, the shoulder 312 rests against the ridge 314 for retaining the nozzle 24 within the housing 20. As noted, the upper portion 308 of the nozzle 24 protrudes above the bottom 326 of the shaft bearing recess 326 when inserted, and the nozzle 24 may be removed by pressing on this uppermost portion 308 to force the shoulder 312 over the ridge 314, thereby releasing the nozzle 24 from the housing 20.

The shaft assembly bearing recess 322 provides a guide and a bearing surface for the rotating shaft assembly 102. More particularly, the upward force of the water stream is applied against the deflector 22, which directs the water away from the vertical direction. This force is resolved in a vertical component and a horizontal component.

More specifically, the water stream tends to push the deflector 22 away from the vertical. In order to maintain the deflector 22 in a generally vertical direction, the shaft assembly bearing recess 322 applies a force against the lower shaft section 132 equal and opposite to the horizontal component created by the water.

However, as the shaft assembly 102 rotates, the forces between the shaft assembly bearing recess 322 and the lower shaft section 132 generate friction. In addition, because of their proximity to the nozzle exit 304, the friction surfaces of the shaft bearing recess 322 and the lower shaft section 132 may receive some amount of dirt or particulate matter therebetween, which can cause additional wear, particularly uneven wear.

In order to combat this uneven wear, a high wear-resistance surface is provided either on the lower shaft section 132, in the shaft assembly bearing recess 322, or both. The surface may be formed directly on the lower shaft section 132 and/or the inner wall 324 the shaft assembly bearing recess 322, or may be a portion of a separate component.

Figure 19:
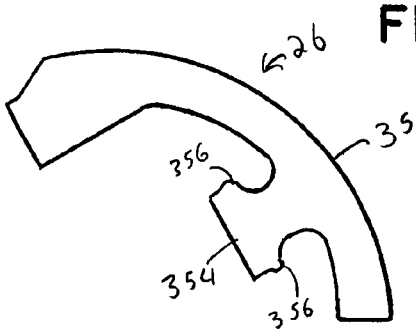
FIG. 19 is a top plan view of an embodiment of the bearing of FIG. 2.
Figure 20:
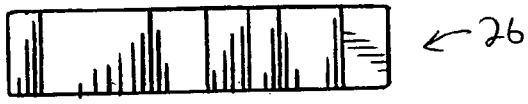
FIG. 20 is a side elevation view of the bearing of FIG. 19.
Figure 21:
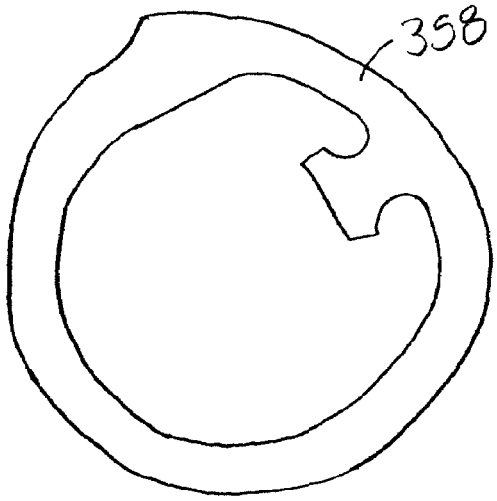
FIG. 21 is a top plan view of an embodiment of the bearing.

In the present embodiment, the high wear-resistance surface is provided by a ceramic material formed as a ceramic bearing 26, as best depicted in FIGS. 19 and 20. The ceramic material also presents a low-friction material. The bearing 26 may be snap-fit into an opening defined by the lower shaft section 132 such that a wear surface 352 on the bearing 26 is positioned opposite the direction of water expulsion from the deflector 22 attached to the lower shaft section 132. Alternatively, the bearing 26 may be a ring 358, as shown in FIG. 21, mounted to either the lower shaft section 132 or the deflector.

Accordingly, when the force caused by the water moving through the deflector 22 cause the lower shaft section 132 to press against the shaft assembly bearing recess 322, the bearing 26 and its material reduces the friction wear. In this manner, the wear between the lower shaft section 132 and the shaft assembly bearing recess 322 is more controlled and predictable, and any aberrations in wear on the shaft assembly bearing recess 322 reduce substantially the potential for any ill-effects in the operation of the sprinkler head 10.

As can be seen, the wear surface 352 of the bearing 26 has an arcuate profile. The bearing 26 is preferably snap-fit into the lower shaft section 132. Accordingly, in an exemplary form, the bearing 26 includes a T-shaped prong 354 with a pair of legs 356. The lower shaft section 132 includes a recess or cavity in the form of a rear bearing mount 360 for receiving the bearing 26 (see FIG. 7). The bearing 26 is pushed into the bearing mount 360 such that the legs 356 snap into and, then, hook into a recess (not shown) or other feature in the bearing mount 360.

As mentioned, there is also a vertical force component produced by the water flowing through the deflector 22, which is secured to the shaft assembly 102. The shaft assembly 102 is held by the annular flange 140 of the upper shaft section 130 between the spring washer 170 and the brake cap annular wall 162. As the shaft assembly 102 rotates, there is friction between the annular flange 140 of the upper shaft section 130 and each of the brake cap annular wall 162 where the top surface 142 is a first contact surface that abuts a second contact surface formed by the annular wall 162, the spring washer 170, and the spring 160. The friction force between these components is dependent on the compression force therebetween, and the abutting surfaces form a regulated braking mechanism.

In this system, the compression force varies based on the flow rate of the water stream striking the deflector 22, as well as the pressure of the flow stream exiting the nozzle 24. Thus, when the water flow and pressure vary, the compression force varies, and the friction force varies. In this manner, the friction force serves as a flow-dependent brake, as well as a pressure-dependent brake. Such braking is important to control otherwise erratic behavior by the sprinkler head 10, specifically, overly rapid rotation of the rotating assemblies which reduces the efficiency of the sprinkler.

Referring now to FIGS. 8, and 12 through 18, an exemplary deflector 22 is depicted. As discussed above, the deflector 22 is secured to the lower shaft section 132. More specifically, the lower shaft section 132 has a cavity for receiving the deflector 22 in the form of a deflector mount 390 (see FIG. 7). The deflector mount 390 passes through the lower shaft section 132 with a large opening 392 in the front 394, or side facing the direction of water expulsion, and a smaller opening 396 in the rear, or side facing away from the direction of water expulsion. The deflector mount 390 is framed by a generally flat bottom surface 398 and generally flat side walls not shown.

The deflector 22 has a generally flat bottom 420 and a rearwardly-projecting securing hook 422 with a downwardly-directed barb 424. The deflector 22 is inserted with the bottom 420 and hook 422 leading such that the barb 424 is directed out of the rear opening 396 of the deflector mount 390 and downwardly therefrom against a rear, outer surface 402 of the lower shaft section 132 above the ceramic bearing 350 (see FIG. 8). Pressure is then applied to a front area 430 of the deflector 22, thereby forcing the deflector 22 into a seated position in the deflector mount 390.

The deflector 22 is preferably snap-fit in the lower shaft section 132, and preferably may be installed manually. Accordingly, a top, front edge 432 of the deflector 22 is provided with a generally vertical profile. When forcing the deflector 22 into the seated position, the front edge 432 passes beyond a ridge 406 formed on a top interior 408 of the deflector mount 390. In order to removed or replace the deflector 22, pressure, such as manual pressure, may be exerted on the hook 422 to force the front edge 432 back over the ridge 406, thereby releasing the deflector 22 from the lower shaft section 132 and the sprinkler head 10.

As discussed, the nozzle 24 and deflector 22 are in fluid communication, such that the water stream exits the nozzle 24 and is directed through the deflector 22. That is, water passes through a deflector channel 440, which includes a deflector surface 442, though the nozzle 24 and deflector 22 are separated by a short distance. A lowermost point 444 of the channel 440 is proximately located to the exit 304 of the nozzle 24, and the deflector surface 442 is generally vertical and planar or slightly arched in the direction of water expulsion. Beginning at least near the lowermost point 444, the deflector surface 442 curves such that the channel 440 redirects the water stream flows for expulsion from an uppermost point 450 of the deflector channel 440 and outwardly from the sprinkler head 10.

The channel 440 may have a varying profile. For instance, at a region 452 of the channel 440 adjacent the uppermost point 450, the channel 440 may split into a plurality of arcuate paths 454 having different degrees of arc and depth. In this manner, portions of the water stream expelling at different locations along the deflector surface 442 at the uppermost point 450 are provided with different trajectories. Accordingly, the single deflector 22 can provide for directing water over several distances, thereby providing for more even broader radial coverage of water spray.

Figure 9:
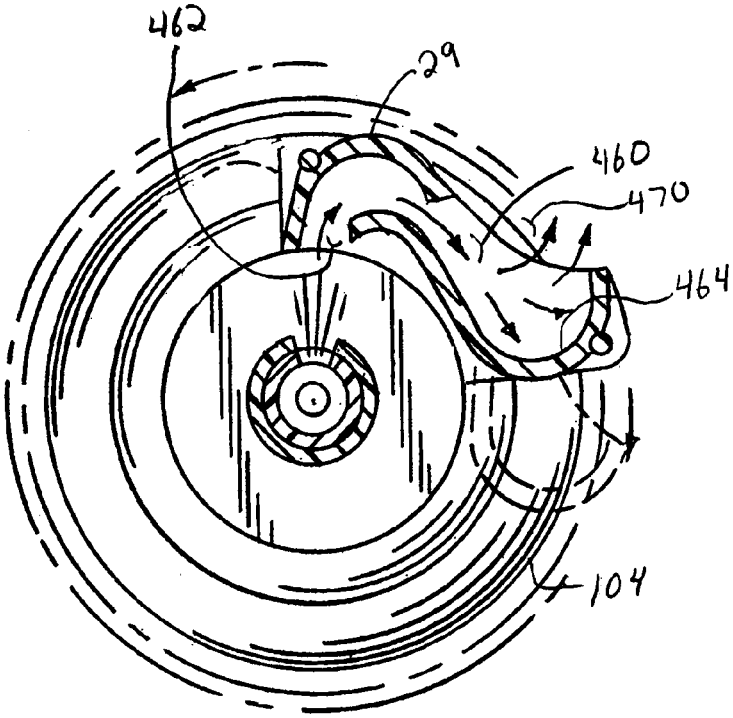
FIG. 9 is a cross-sectional view taken along the line 9-9 of FIG. 6.

As has been stated, the disk assembly 104 oscillates, in essence, with respect to the shaft assembly 102 due to the forces of the water stream on the spoon 29 and the bias of the torsion spring 260. Illustrated in FIG. 9 is the spoon 29 in a position for interfering with the expelling of water from the deflector 22, and a second, non-interfering position is partially shown in phantom. The spoon 29 may be a reversed S-Shaped form as illustrated in FIG. 9 and forms a generally reversed S-shaped channel 460. In the interfering position, the water enters the spoon 29 through an entrance 462 and is redirected in a lateral direction. The water then follows the channel 460 until it strikes a curved dead-end wall 464. The striking against the wall 464 provides a force for rotating the spoon 29 out of the path of the water stream.

The curved wall 464 generally faces in a direction generally tangential to the disk assembly 104. Therefore, the water is discharged from the spoon 29 through an exit 470 in a line directed outwardly from disk assembly 104. Furthermore, the preferred embodiment of the spoon 29 is secured to the generally frusto-conical outer surface 244 of the shell 240. Thus, the spoon 29 is positioned obliquely above the horizontal direction (see FIG. 6). Accordingly, the water is discharged from the exit 470 in an outward direction above the horizontal. This enables the spoon 29 to also contribute to provide irrigation benefits by providing distribution of the water while also using the force of the water to rotate the disk assembly 104.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. An irrigation device for dispersing water over an area comprising:

a housing having a top portion and a base portion being connectable to a water source and having an interior surface defining a recess;

a rotatable water discharge assembly having an upper portion being supported from above by the top portion of the housing and defining an axis of rotation, a deflector for directing water discharge in a predetermined direction from the discharge assembly, and a bottom portion being received generally in the recess, the bottom portion having an exterior surface; located at least generally opposite the predetermined direction of water discharge and opposing at least a portion of the interior surface of the recess during operation of the irrigation device; and a bearing having an outer surface of wear resistant material; and a first cavity defined by either (1) a wall portion of the base portion of the housing adjacent the recess of the base portion of the housing or (2) a wall portion of the bottom portion of the rotatable discharge assembly, the wall portion defining all sides of the first cavity and leaving a radial facing opening leading to the recess and open in a direction transverse to the axis of rotation, the first cavity and the recess being adjacent one another and the bearing being received in the cavity to engage one of the interior surface or the exterior surface opposite the predetermined direction of water discharge as the deflector rotates to reduce wear at a sliding engagement between the bearing and one of the interior surface and the exterior surface.

2. The irrigation device of claim 1 wherein the bearing is removably attached to the bottom portion of the rotatable water discharge assembly.

3. The irrigation device of claim 2 wherein the bearing is ceramic.

4. The irrigation device of claim I wherein the bearing includes at least one prong with at least one leg forming a locking engagement with the first cavity.

5. The irrigation device of claim 3 wherein the bearing includes a partial ring portion.

6. The irrigation device of claim 4 wherein the at least one prong includes a snap lock with the first cavity in forming the locking engagement with the first cavity.

7. The irrigation device of claim 1 wherein the bearing is removably attached at the first cavity to face and engage the bottom portion of the discharge assembly that is generally opposite the predetermined direction of water discharge from the deflector.

8. The impact sprinkler of claim 1 further comprising a plurality of deflectors and each of the plurality of deflectors being capable of changing the flow characteristics of the water stream discharging from the sprinkler.

9. The impact sprinkler of claim 1 further comprising a plurality of nozzles and each of the plurality of nozzles being capable of being separately and removably supported in the base portion of the housing for directing a water stream to the deflector and providing a different flow rate for the water stream being directed to the deflector.

10. The irrigation system of claim 9 wherein when any one of the plurality of nozzles is supported in the base portion, the supported nozzle and the deflector are separated by an open air space.

11. An irrigation device for dispersing water over an area comprising:

a housing having a top portion and a base portion being connectable to a water source and having an interior surface defining a recess;

a rotatable water discharge assembly having an upper portion being supported from above by the top portion of the housing, a deflector for directing water discharge in a predetermined direction from the discharge assembly, and a bottom portion being received generally in the recess, the bottom portion having an exterior surface located at least generally opposite the predetermined direction of water discharge and opposing at least a portion of the interior surface of the recess during operation of the irrigation device;

a bearing having an outer surface of wear resistant material;

a first cavity defined by either (1) the base portion of the housing adjacent the recess of the base portion of the housing or (2) the bottom portion of the rotatable discharge assembly, the bearing being received in the cavity to engage one of the interior surface or the exterior surface opposite the predetermined direction of water discharge as the deflector rotates to reduce wear at a sliding engagement between the bearing and one of the interior surface and the exterior surface;

the bearing includes at least one prong forming a locking engagement with the first cavity;

the at least one prong includes a snap lock with the first cavity in forming the locking engagement with the first cavity; and wherein the at least one prong has a generally t-shaped portion forming at least in part the snap lock with the cavity to removably attach the bearing thereto.

12. The impact sprinkler of claim 10 An impact sprinkler comprising:

a housing;

a shaft assembly rotatably supported by the housing and including a first deflector for directing water discharge from the sprinkler and a pin having an upper portion with an upper terminal end surface;

an impact assembly defining a blind hole that receives the upper portion of the pin to be rotatably supported by the shaft assembly and including an impact member that contacts the shaft assembly to rotatably advance the shaft assembly to rotate the first deflector to redirect the water discharge, a second deflector configured to receive water from the first deflector to cause the second deflector to rotate away from the water discharging from the first deflector, and a spring biasing the impact member into contact with the shaft assembly once the second deflector rotates out of the water discharging from the first deflector and the blind hold sliding longitudinally along the pin away from engagement with the upper terminal end surface to reduce rotational friction between the blind hole and the pin;

whereby the area of contact between the impact assembly and the pin of the shaft is reduced to reduce rotational friction therebetween to increase the time when the second deflector is out of the water discharge to increase the effect of the water discharge from the sprinkler, and wherein clearance exists above the impact assembly such the impact assembly is allowed to slide longitudinally on the pin in a direction away from the terminal end surface of the pin during irrigation to reduce friction between the impact assembly and the pin of the shaft assembly such that the water discharge from the first deflector reaches a maximum radial distance from the sprinkler when the second deflector has rotated out of the water discharging from the first deflector, and when the second deflector remains out of the water discharging from the first deflector, the maximum distance and the effect of the water discharge from the sprinkler increases.

13. The impact sprinkler of claim 12 wherein a bottom of the blind hole of the impact assembly sporadically contacts the upper terminal end surface of the pin, and wherein the upper terminal end surface of the pin is minimized to reduce the area of contact between the impact assembly and the shaft assembly.

14. The impact sprinkler of claim 12 wherein the second deflector is oriented to tend to shift the impact assembly along the pin toward the housing when in position to receive water from the first deflector.

15. The impact sprinkler of claim 14 wherein the second deflector defines a channel with a generally reversed S-shaped configuration with reference to receiving water from the first deflector and formed by at least two arcuate walls.

16. The impact sprinkler of claim 14 wherein the second deflector is mounted at an angle relative to the pin of the shaft assembly such that water discharging from the second deflector has an initial trajectory above horizontal when the impact sprinkler is oriented with the pin generally vertical.

17. An irrigation device for dispersing water over an area comprising:

a housing having a top portion and a base portion being connectable to a water source and having an interior surface defining a recess;

a rotatable water discharge assembly having an upper portion being supported from above by the top portion of the housing, a deflector for directing water discharge in a predetermined direction from the discharge assembly, and a bottom portion being received generally in the recess, the bottom portion having an exterior surface located at least generally opposite the predetermined direction of water discharge and opposing at least a portion of the interior surface of the recess during operation of the irrigation device; and a bearing having an outer surface of wear resistant material; and a first cavity defined by either (1) the base portion of the housing adjacent the recess of the base portion of the housing or (2) the bottom portion of the rotatable discharge assembly, the bearing being received in the cavity to engage one of the interior surface or the exterior surface opposite the predetermined direction of water discharge as the deflector rotates to reduce wear at a sliding engagement between the bearing and one of the interior surface and the exterior surface; and a nozzle supported in the recess for producing a water stream with a flow rate, and wherein the discharge assembly has an upper moveable contact surface and an upper fixed contact surface that engage to control the speed of rotation of the discharge assembly through friction therebetween by increasing the friction therebetween as the flow rate increases, and the deflector being positioned intermediate the upper moveable contact surface and the upper fixed contact surface.

18. The irrigation device of claim 17 wherein water from the nozzle contacting the deflector causes the deflector to produce a first force component resulting in the upper moveable contact surface being engaged with the upper fixed contact surface and the bearing being engaged with either of the exterior surface of the bottom portion of the discharge assembly or the interior surface of the first recess of the housing being engaged to control rotation of the discharge assembly in response to the flow rate of the water stream.

19. The irrigation device of claim 18 wherein water contacting the deflector causes the deflector to produce a second force component resulting in the first force component causing the upper moveable contact surface to be engaged with the upper fixed contact surface and the second force component causing the bearing to be engaged with either of the exterior surface of the bottom portion of the discharge assembly or the interior surface of the first recess of the housing to control rotation of the discharge assembly in response to the flow rate of the water stream.

20. The irrigation device of claim 19 wherein the interior and exterior surfaces and the outer surface of the bearing are generally arcuate.

21. The irrigation device of claim 19 wherein the discharge assembly comprises a shaft assembly and the shaft assembly includes an axis of rotation and the first force component is generally along the axis of rotation.

22. The irrigation device of claim 21 wherein the second force component is generally transverse to the first force component.

23. The irrigation device of claim 18 wherein the discharge assembly further comprises a spring biasing the upper moveable contact surface into engagement with the upper fixed contract surface.

24. An irrigation device for dispersing water over an area comprising:

a housing having a top portion and a base portion being connectable to a water source and having an interior surface defining a recess;

a rotatable water discharge assembly having an upper portion being supported from above by the top portion of the housing, a deflector for directing water discharge in a predetermined direction from the discharge assembly, and a bottom portion being received generally in the recess, the bottom portion having an exterior surface located at least generally opposite the predetermined direction of water discharge and opposing at least a portion of the interior surface of the recess during operation of the irrigation device;

a bearing having an outer surface of wear resistant material;

a first cavity defined by either (1) the base portion of the housing adjacent the recess of the base portion of the housing or (2) the bottom portion of the rotatable discharge assembly, the bearing being received in the cavity to engage one of the interior surface or the exterior surface opposite the predetermined direction of water discharge as the deflector rotates to reduce wear at a sliding engagement between the bearing and one of the interior surface and the exterior surface; and the deflector comprises a first deflector and the discharge assembly comprises a shaft assembly including the first deflector and an impact assembly supported by the shaft assembly, wherein the impact assembly includes an impact member that contacts the shaft assembly to rotatably advance the shaft assembly to rotate the first deflector to redirect the water discharge, a second deflector positioned and configured to receive water from the first deflector to cause the second deflector to rotate away from the water discharging from the first deflector, and a spring biasing the impact member into contact with the shaft assembly once the second deflector rotates out of the water discharging from the first deflector.

25. An irrigation device for dispersing water over an area comprising:

a housing having a top portion and a base portion being connectable to a water source and having an interior surface defining a recess;

a rotatable water discharge assembly having an upper portion being supported from above by the top portion of the housing, a deflector for directing water discharge in a predetermined direction from the discharge assembly, and a bottom portion being received generally in the recess, the bottom portion ion an exterior surface, located at least generally opposite the predetermined direction of water discharge and opposing at least a portion of the interior surface of the recess during operation of the irrigation device;

a bearing having an outer surface of wear resistant material;

a first cavity defined by either (1) a wall portion of the base portion of the housing adjacent the recess of the base portion of the housing or (2) a wall portion of the bottom portion of the rotatable assembly, the wall portion defining all sides of the first cavity and leaving a radial facing opening leading to the recess, the first cavity and the recess being separate and adjacent one another and the bearing being received in the cavity to engage one of the interior surface or the exterior surface opposite the predetermined direction of water discharge as the deflector rotates to reduce wear at a sliding engagement between the bearing and one of the interior surface and the exterior surface; and a plurality of deflectors and each of the plurality of deflectors being capable of changing the flow characteristics of the water stream discharging from the sprinkler, wherein the rotatable water discharge assembly defines a socket, each of the plurality of deflectors are designed to each be easily mounted in and removed from the socket so to be readily interchangeable with one another to change the flow characteristics of the water stream discharging from the sprinkler.

26. The impact sprinkler of claim 25 wherein the flow characteristics include trajectory and/or water distribution patterns.

27. The impact sprinkler of claim 26 wherein each of the plurality of deflectors includes a different identification indicia to easily distinguish among them.

28. The impact sprinkler of claim 27 wherein the identification indicia is a different color.

29. An irrigation device for dispersing water over an area comprising:

a housing having a top portion and a base portion being connectable to a water source and having an interior surface defining a recess;

a rotatable water discharge assembly having an upper portion being supported from above by the top portion of the housing, a deflector for directing water discharge in a predetermined direction from the discharge assembly, and a bottom portion being received generally in the recess, the bottom portion having an exterior surface located at least generally opposite the predetermined direction of water discharge and opposing at least a portion of the interior surface of the recess during operation of the irrigation device;

a bearing having an outer surface of wear resistant material;

a first cavity defined by either (1) a wall portion of the base portion of the housing adjacent the recess of the base portion of the housing or (2) a wall portion of the bottom portion of the rotatable discharge assembly, wall portion defining all sides of the first cavity and leaving a radial facing opening leading to the recess, the first cavity and the recess being adjacent one another and the bearing being received in the cavity to engage one of the interior surface or the exterior surface opposite the predetermined direction of water discharge as the deflector rotates to reduce wear at a sliding engagement between the bearing and one of the interior surface and the exterior surface; and a plurality of nozzles and each of the plurality of nozzles being capable of being separately and removably supported in the base portion of the housing for directing a water stream to the deflector and providing a different flow rate for the water stream being directed to the deflector, wherein the base portion includes an inlet connectable to a water source and defining a second cavity, the plurality of nozzles are each easily mounted in and removed from the second cavity through the inlet so to be readily interchangeable to change the flow rate of the water stream.

30. The impact sprinkler of claim 29 wherein each of the plurality of nozzles includes a different identification indicia to easily distinguish among them.

31. The impact sprinkler of claim 30 wherein the identification indicia is a different color.

32. An impact sprinkler comprising:

a housing having a mounting collar at one end, a base at an end opposite the mounting collar that is connectable to a water source and a plurality of spaced protective members interconnecting the mounting collar and the base;

a rotatable shaft assembly supported in the housing by a fixed attachment in the mounting collar and having a deflector for directing discharging from the sprinkler; and an impact assembly being rotatable supported by the shaft assembly and including an impact member that operates into and out of contact with the shaft assembly and when in contact with the shaft assembly causes the shaft assembly to rotatably advance the deflector to redirect the water discharge, wherein the plurality of spaced protective members of the housing protect the rotatable shaft assembly and the impact assembly from interference by foreign matter, and wherein the mounting collar has a plurality of support flats extending radially inward and aligned with the plurality of protective members, wherein the rotatable shaft assembly is supported by the support flats in the collar.

33. The impact sprinkler of claim 32 wherein the rotatable shaft assembly further comprises at least one flat.

34. An impact sprinkler comprising:

a housing having an upper portion;

a rotatable shaft assembly rotatably supported by the upper portion and having a deflector for directing water discharging from the sprinkler;

an impact assembly being rotatably supported by the shaft assembly and including an impact member that operates into and out of contact with the shaft assembly and when in contact with the shaft assembly causes the shaft assembly to rotatably advance the deflector to redirect the water discharge;

a plurality of spaced protective members of the housing to protect the rotatable shaft assembly and the impact assembly from interference by foreign matter;

the housing upper portion comprises a mounting ring, the mounting ring having a plurality of supports flats extending therefrom and aligned with the plurality of protective members, wherein the impact assembly is supported by the support flats;

the impact assembly further comprises at least one flat; and the mounting ring further comprises at least one stop tab projecting therefrom that cooperates with the at least one flat to limit movement of the impact assembly in at least a first direction.

35. An impact sprinkler comprising:

a housing having an upper portion;

a rotatable shaft assembly rotatably supported by the upper portion and having a deflector for directing water discharging from the sprinkler;

an impact assembly being rotatably supported by the shaft assembly and including an impact member that operates into and out of contact with the shaft assembly and when in contact with the shaft assembly causes the shaft assembly to rotatably advance the deflector to redirect the water discharge;

a plurality of spaced protective members of the housing to protect the rotatable shaft assembly and the impact assembly from interference by foreign matter;

the housing upper portion comprises a mounting ring, the mounting ring having a plurality of supports flats extending therefrom and aligned with the plurality of protective members, wherein the impact assembly is supported by the support flats;

the impact assembly further comprises at least one flat;

the mounting ring further comprises at least one stop tab projecting therefrom that cooperates with the at least one flat to limit movement of the impact assembly in at least a first direction; and the mounting ring has at least one locking member comprising a first ramped surface and a first stop surface and wherein the rotatable shaft assembly has at least one locking member comprising a second ramped surface and a second stop surface.

36. The impact sprinkler of claim 35 wherein the rotatable shaft assembly is secured to the housing by rotating the impact assembly such that the first stop surface abuts the second stop surface to limit rotation in a second direction and the at least one stop tab abuts the at least one flat to limit rotation in the first direction.

* * * * *

UNITED STATES PATENT AND TRADEMARK OFFICE

CERTIFICATE OF CORRECTION

PATENT NO. : 7,954,731 B2
APPLICATION NO. : 10/860818
DATED : June 7, 2011
INVENTOR(S) : Thomas A. Antonucci et al.

It is certified that error appears in the above-identified patent and that said Letters Patent is hereby corrected as shown below:

ON THE TITLE PAGE:

Column 2, item (57) Abstract, lines 1-26, delete "A rotary impact sprinkler is disclosed having a nozzle connected to a housing and a discharge deflector member connected to a rotatable shaft assembly without a dynamic seal between the nozzle and the deflector. The sprinkler may be provided with different nozzles and discharge deflectors that are easily removed and replaced for providing desired water flow and discharge characteristics. The shaft assembly and housing may have contacting braking surfaces outside of the water flow. The braking surfaces may provide a frictional braking force dependent on both water flow rate and water flow pressure. The sprinkler has a rotatable impact assembly supported by the shaft assembly and including a deflection member for rotating the impact assembly relative to the shaft assembly. The shaft assembly may have a pin for supporting the impact assembly at a position above the deflection member. A lower portion of the shaft assembly may be positioned in a recess in the housing such that a surface on the shaft assembly contacts a surface in the recess, and a highly wear resistant material may be disposed on the surface of either the shaft assembly or the recess for providing improved wear characteristics. The deflection member of the impact assembly may have a channel that receives a portion of the water stream for rotating the impact assembly, and the channel may expel the water from the sprinkler. The discharge deflector may have a varying profile for discharging water at varying trajectories." and insert --An impact sprinkler has a nozzle connected to a housing and a discharge deflector member connected to a rotatable shaft assembly without a dynamic seal between the nozzle and the deflector. The sprinkler has different replaceable nozzles and discharge deflectors for providing desired discharge characteristics. The shaft assembly and housing have contacting braking surfaces outside of the water flow providing a frictional braking force dependent on both water flow rate and pressure. The sprinkler has a deflection member for rotating an impact assembly relative to the shaft assembly while a pin supports the impact assembly at a position above the deflection member. A lower portion of the shaft assembly may be positioned in a housing recess, and a highly wear resistant material may be disposed on a surface of either the shaft assembly or the recess for providing improved wear characteristics.-- therefor.

IN THE CLAIMS:

Signed and Sealed this
Twelfth Day of May, 2015

Michelle K. Lee

Michelle K. Lee
*Director of the United States Patent and Trademark Office*

Column 12, line 62, in claim 1, delete “surface;” and insert --surface-- therefor.

Column 13, line 20, in claim 4, delete “claim I” and insert --claim 1-- therefor.

Column 14, line 14, in claim 12, before “An” delete “The impact sprinkler of claim 10”.

Column 16, line 7, in claim 23, delete “contract” and insert --contact-- therefor.

Column 16, line 57, in claim 25, delete “ion” and insert --having-- therefor.

Column 16, line 67, in claim 25, after “rotatable” insert --discharge--.

Column 17, line 47, in claim 29, after “assembly” insert --the--.

Column 18, line 13, in claim 32, after “directing” insert --water--.

Column 18, line 15, in claim 32, delete “rotatable” and insert --rotatably-- therefor.